US009943145B2

(12) United States Patent
Papais et al.

(10) Patent No.: US 9,943,145 B2
(45) Date of Patent: Apr. 17, 2018

(54) ARTICLE OF JEWELRY HAVING A REPLACEABLE ORNAMENTAL ELEMENT

(71) Applicant: LINX SRL, Rome (IT)

(72) Inventors: Mauro Papais, Rome (IT); Ingrid Guzman, Rome (IT)

(73) Assignee: LINX SRL, Rome (IT)

( * ) Notice: Subject to any disclaimer, the term of this patent is extended or adjusted under 35 U.S.C. 154(b) by 13 days.

(21) Appl. No.: 14/916,273

(22) PCT Filed: Sep. 2, 2014

(86) PCT No.: PCT/IT2014/000228
§ 371 (c)(1),
(2) Date: Mar. 3, 2016

(87) PCT Pub. No.: WO2015/033366
PCT Pub. Date: Mar. 12, 2015

(65) Prior Publication Data

US 2016/0213106 A1 Jul. 28, 2016

(30) Foreign Application Priority Data

Sep. 3, 2013 (IT) ..... RM2013A0486

(51) Int. Cl.
*A44C 13/00* (2006.01)
*A44C 9/00* (2006.01)
*A44C 17/02* (2006.01)
*A44C 25/00* (2006.01)

(52) U.S. Cl.
CPC ..... *A44C 17/0208* (2013.01); *A44C 9/00* (2013.01); *A44C 25/001* (2013.01); *A44D 2203/00* (2013.01)

(58) Field of Classification Search
CPC ..... A44C 17/0208; A44C 9/00; A44C 25/001; A44D 2203/00; Y10T 24/32
USPC ..... 63/29.2, 40, 900
See application file for complete search history.

(56) References Cited

U.S. PATENT DOCUMENTS

2012/0180522 A1* 7/2012 Severs ..... A44C 17/0208 63/12

* cited by examiner

*Primary Examiner* — Jack W Lavinder
(74) *Attorney, Agent, or Firm* — Young & Thompson

(57) ABSTRACT

An article of jewelry having a replaceable ornamental element has in combination a frame (2) provided with a central recess (3), an ornamental element (4) adapted to be received in the central recess (3), a first magnet (5) fixed to the bottom (6) of the ornamental element (4), and a second magnet (7) fixed inside the central recess (3) for removably assure the ornamental element (4) therein.

5 Claims, 8 Drawing Sheets

ARTICLE OF JEWELRY HAVING A REPLACEABLE ORNAMENTAL ELEMENT

CROSS-REFERENCE TO RELATED APPLICATION

This application is a national phase entry of International Application No. PCT/IT2014/000228, filed Sep. 2, 2014 and titled "Article of Jewelry Having a Replaceable Ornamental Element," which claims priority to and the benefit of Italian Patent Application No.: RM2013A000486, filed Sep. 3, 2013 and titled "Article of Jewelry Having a Replaceable Ornamental Element." The contents of the above-identified Applications are relied upon and incorporated herein by reference in their entirety.

TECHNICAL FIELD

The present invention relates to an article of jewelry having a replaceable ornamental element. The interested jewelry can be precious or not.

BACKGROUND ART

There are already articles of jewelry, such as rings, earrings, pendants, wherein a frame or support body and an ornamental element are mutually joined together by magnetic attraction. This allows a wearer to replace the ornamental element with another as desired.

Among others, U.S. Pat. No. 6,594,871 discloses a jewelry piece comprising, in combination, a frame provided with a central recess, a decorative element to be received within the central recess, a first magnet fixed to the bottom of the decorative element, at least one other magnet being fixed within the central recess for securing the decorative element therewithin, and an aperture extending through the bottom of the central recess of the frame for providing access for a stylus for selectively dislodging the decorative element from the frame. According to an embodiment of the invention, a pair of magnets separated by a given distance from each other is fixed within the central recess of the frame. This distance allows to attract, between the pair of magnets fixed in the central recess, the magnet attached to the bottom of the decorative element.

It is understood that the jewelry piece according to U.S. Pat. No. 6,594,871 has the drawback of requiring a stylus, that is, a tool for the removal of the decorative element that is within the frame and cannot be grasped with the fingers.

U.S. Pat. No. 3,509,734 describes a device for ornamental use comprising a base element and an ornament element detachably mounted thereto by magnetic attraction. The ornamental element has an outer ornamental surface and an inner surface provided with a raised portion serving as insert means. The ornament element has, in its inner surface, at least two elongated pin-like projections, and the base element has holes corresponding to the projections adapted to receive them, without any interference with the wearer of the device. The presence of the pin-like projections ensures the centering of ornament element and, at the same time, facilitates the removal of the ornament element by acting on the pin-like projections. However, the structure described is complicated to manufacture.

The European patent EP 1 810 588 describes an article of jewelry having a support body and an ornamental element removably mounted to the support body. According to an embodiment of the invention relating to a ring, the support body has a bushing, and the ornamental element has a pin that can be received in the bushing. Provided coaxially to the bushing and the pin, in the support body and the ornamental element respectively, are circular seats. In the circular seats there are respective ring magnets having opposite magnetic poles.

It is understood that the article of jewelry according to the patent EP 1 810 588 does not require a tool for the ornamental element replacement because the ornamental element can be freely grasped. However, it is understood that likewise the ornamental element can accidentally collide with other objects and slip out of the support body with a risk of getting lost. In fact, the pin has only a centering function of the decorative element and, in no way, a hold function on the support body.

DISCLOSURE OF THE INVENTION

The present invention aims to overcome the above mentioned drawbacks. In particular, an object of the present invention is to provide an article of jewelry bearing a gemstone, which is easily replaceable without requiring the use of a tool.

Also, an object of the invention is to provide an article of jewelry in which the gemstone has a simple structure that is easy to build as well as its frame.

Still an object of the invention is to provide an article of jewelry in which its gemstone is easily replaceable, but is not liable to be accidentally detached from its frame. These objects and others are achieved by an article of jewelry having a replaceable ornamental element comprising in combination a frame provided with a central recess, an ornamental element adapted to be received in the central recess, a first magnet fixed to the bottom of the ornamental element, and a second magnet fixed inside the central recess for removably assure the ornamental element therein, wherein said bottom of the ornamental element has a first perimeter groove acting as a seat for said first magnet being correspondingly shaped to be fixed to said bottom of the ornamental element; the central recess of the frame has internally a perimeter projection in which a second perimeter groove is formed acting as a seat for said second magnet being shaped like said first magnet in order to be fixed to the central recess of the frame, and a through opening extends through the central recess of the frame for the introduction of a finger of a hand being able to allow the decorative element to be removed from the frame.

BRIEF DESCRIPTION OF THE DRAWINGS

The present invention will now be described by an illustrative but not limiting example with reference to the accompanying drawings, in which.

DESCRIPTION OF EMBODIMENTS OF THE INVENTION

Figure 1:
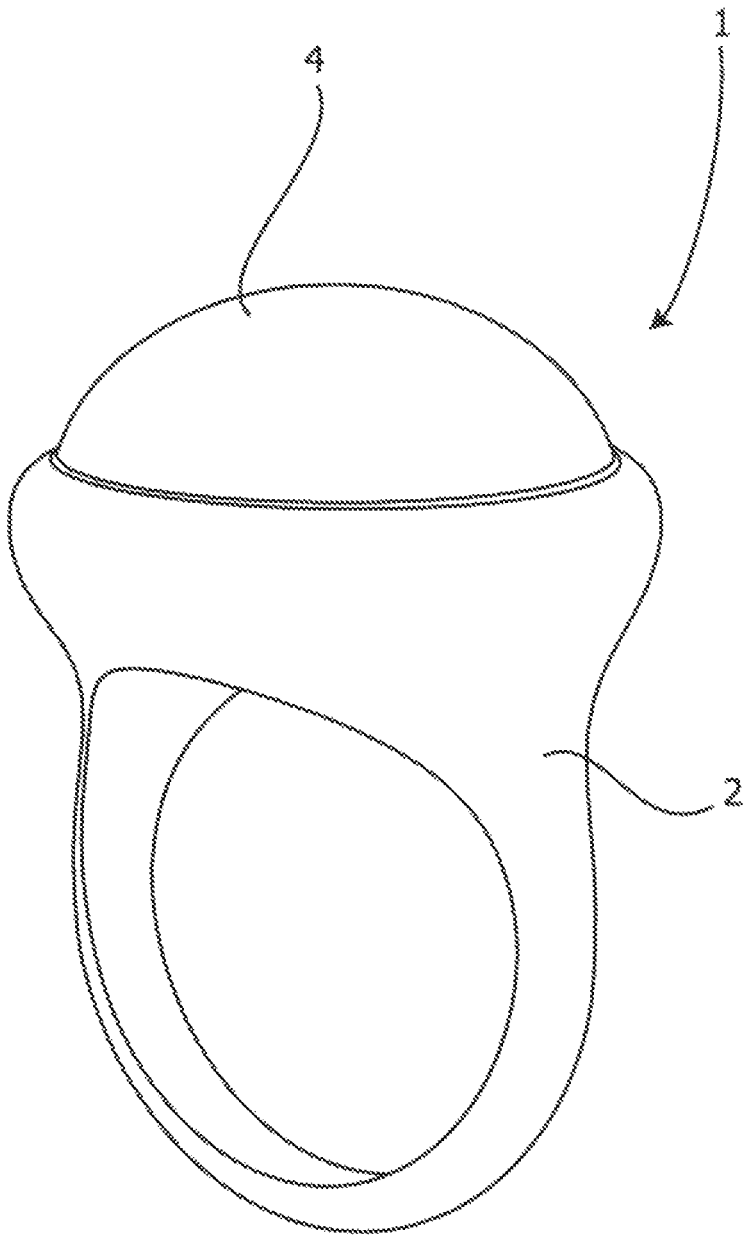
FIG. 1 is an assembled perspective view of an article of jewelry having a replaceable ornamental element according to the present invention in the form of a ring.
Figure 2:
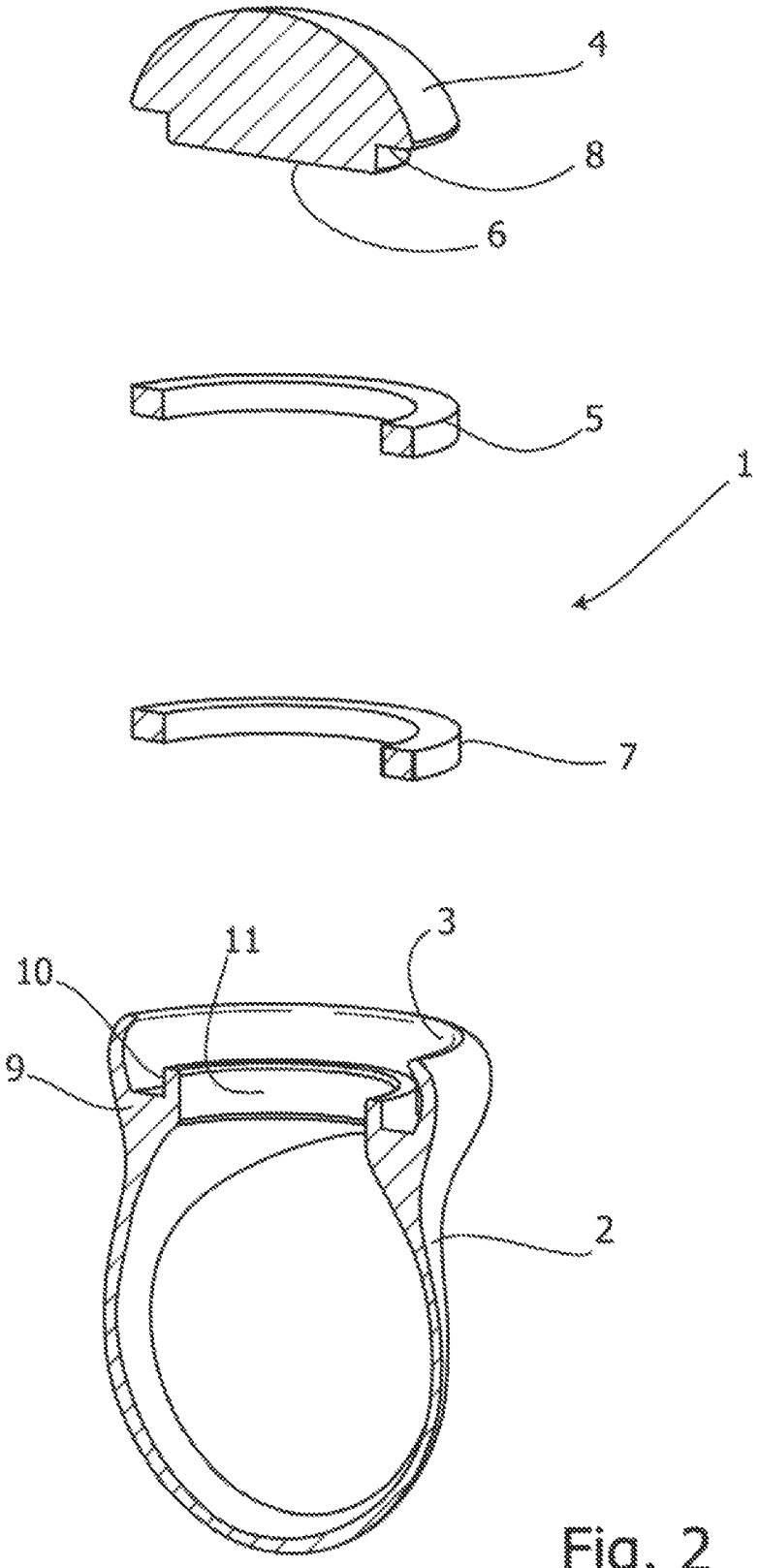
FIG. 2 is an exploded longitudinally sectioned perspective view of the ring in FIG. 1.
Figure 3:
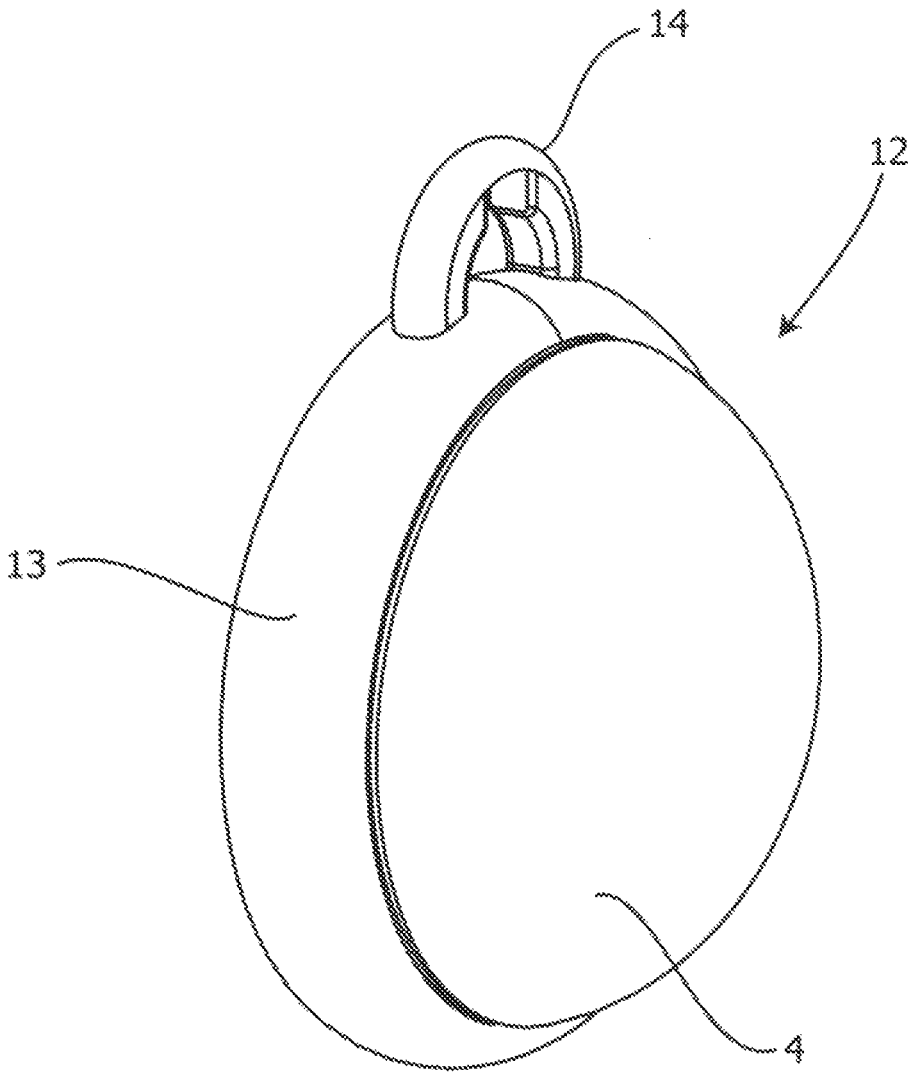
FIG. 3 is an assembled perspective view of an article of jewelry having a replaceable ornamental element according to the present invention in the form of a circular pendant.
Figure 4:
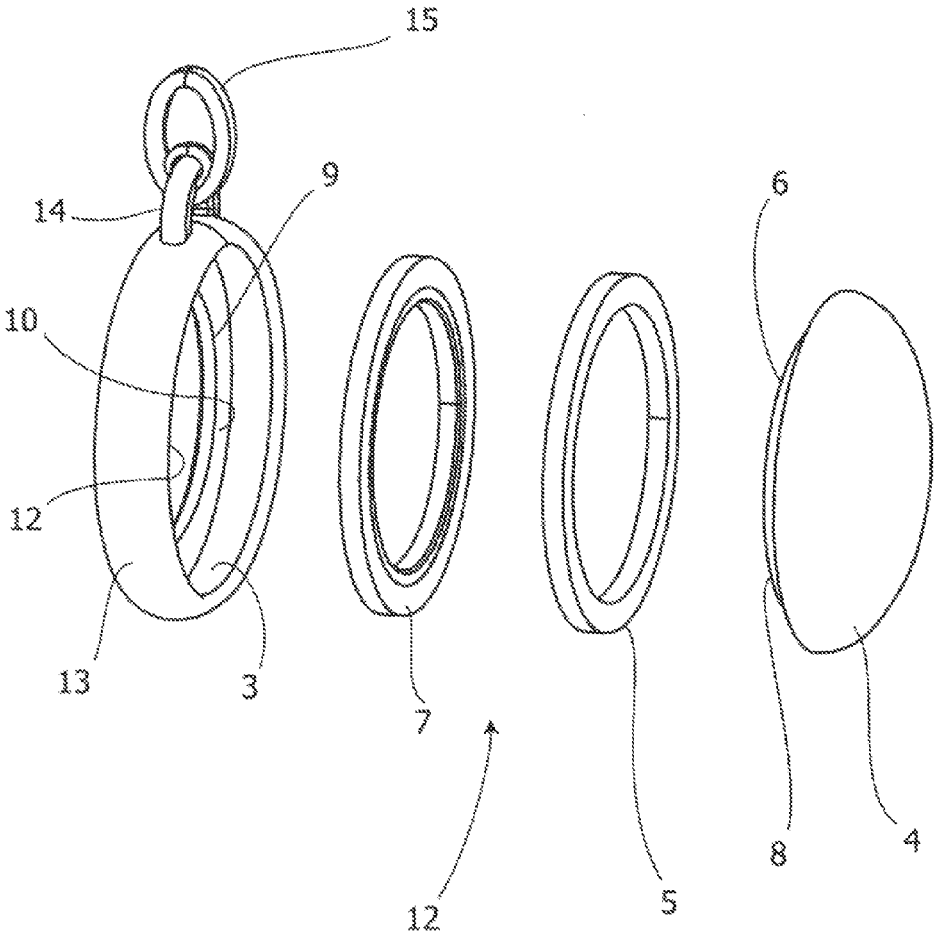
FIG. 4 is an exploded perspective view of the pendant in FIG. 3.
Figure 5:
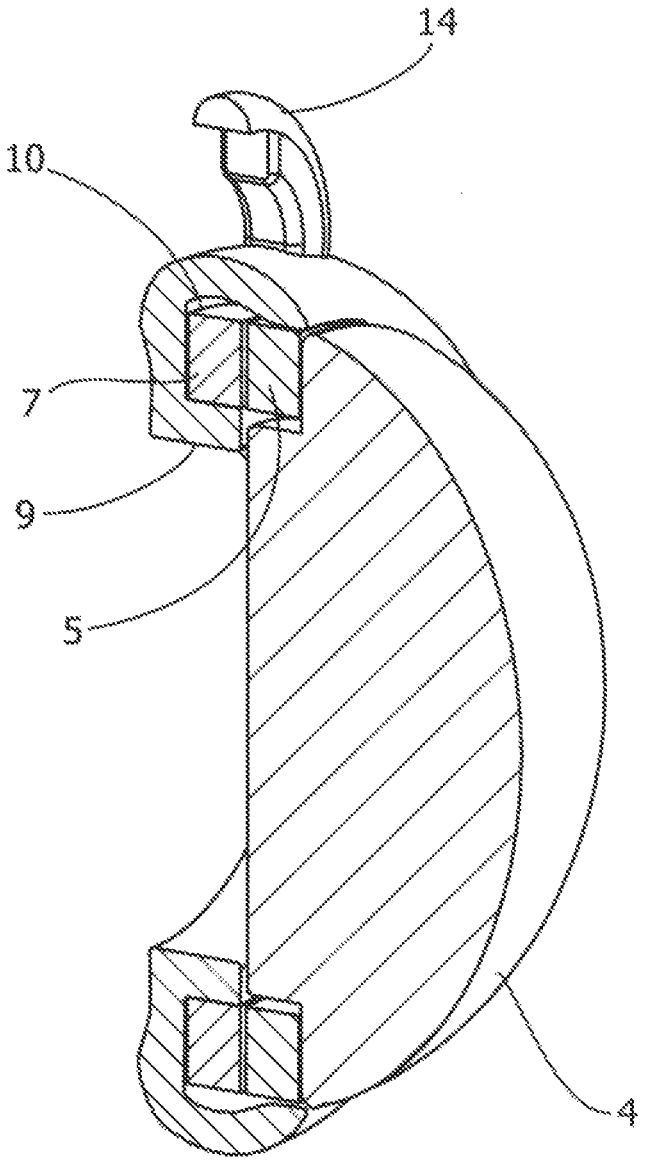
FIG. 5 is a sectional perspective view of the pendant in FIG. 3.

First reference is made to FIGS. 1 and 2 in which there is shown a ring 1 according to the present invention in an assembled and in an exploded sectional perspective view, respectively. The ring 1 is a first embodiment of an article of jewelry having a replaceable ornamental element according to the present invention. The ring 1 comprises a frame 2 provided with a central recess 3. An ornamental element 4, for example a gemstone, is adapted to be received in the central recess 3 of the frame 2. A first magnet 5 is fixed to the bottom 6 of the ornamental element 4, and a second magnet 7 is fixed within the central recess 3 for removably assure the ornamental element 4 therein.

According to the present invention, the bottom 6 of the ornamental element 4 has a first peripheral groove 8 acting as a seat for the first magnet 5 that is shaped correspondingly to the first perimeter groove 8 to be fixed to the bottom 6 of the ornamental element 4. In the shown embodiment the first perimeter groove 8 has a circular shape, consequently also the first magnet 5 has the same circular ring configuration.

The central recess 3 in the frame 2 has inside a perimeter projection 9 in which a second perimeter groove 10 functioning as a seat for the second magnet 7 is formed. The second magnet 7 is shaped like the first magnet 5, to be fixed to the recess central 3 of the frame 2.

The magnets 5 and 7 are fixed in their seats by suitable means such as an adhesive.

A through aperture 11 extends through the central recess 3 of the frame 2. The through aperture 11 has such a dimension that a hand finger can be introduced in it. The finger exerts a pressure on the bottom 6 of the ornamental element 4 for overcoming a mutual attraction force exerted by the two magnets. As will be shown below the removal of the ornamental element from the frame is thus obtained. On the contrary, it will be sufficient to approach the frame to another ornamental element so that the latter is captured and automatically positioned with its bottom in the central recess.

With reference to a second embodiment of the present invention, there is shown a pendant 12 according to the present invention in FIGS. 3 to 6 in an assembled perspective view, exploded view, sectional perspective view and operative view, respectively. In the figures, same or like parts are denoted with the same numbers. The pendant 12 comprises a frame 13 provided with a central recess 3. An ornamental element 4, for example a gemstone, is adapted to be received in the central recess 3 in the frame 13. A first magnet 5 is fixed to the bottom 6 of the ornamental element 4, and a second magnet 7 is fixed within the central recess 3 in the frame 13 for removably assuring the ornamental element 4.

According to the present invention, the bottom 6 of the ornamental element 4 has a first perimeter groove 8 acting as a seat for the first magnet 5 that is shaped correspondingly to the first perimeter groove 8 to be fixed to the bottom 6 of the ornamental element 4. In the embodiment shown the first perimeter groove 8 has a circular shape, consequently also the first magnet 5 has the same circular ring configuration.

The central recess 3 in the frame 13 has inside a perimeter projection 9 in which a second perimeter groove 10 acting as a seat for the second magnet 7 is formed. The second magnet 7 is shaped like the first magnet 5, to be fixed to the central recess 3 of the frame 13.

The magnets 5 and 7 are fixed in their seats by suitable means such as an adhesive.

Figure 6:
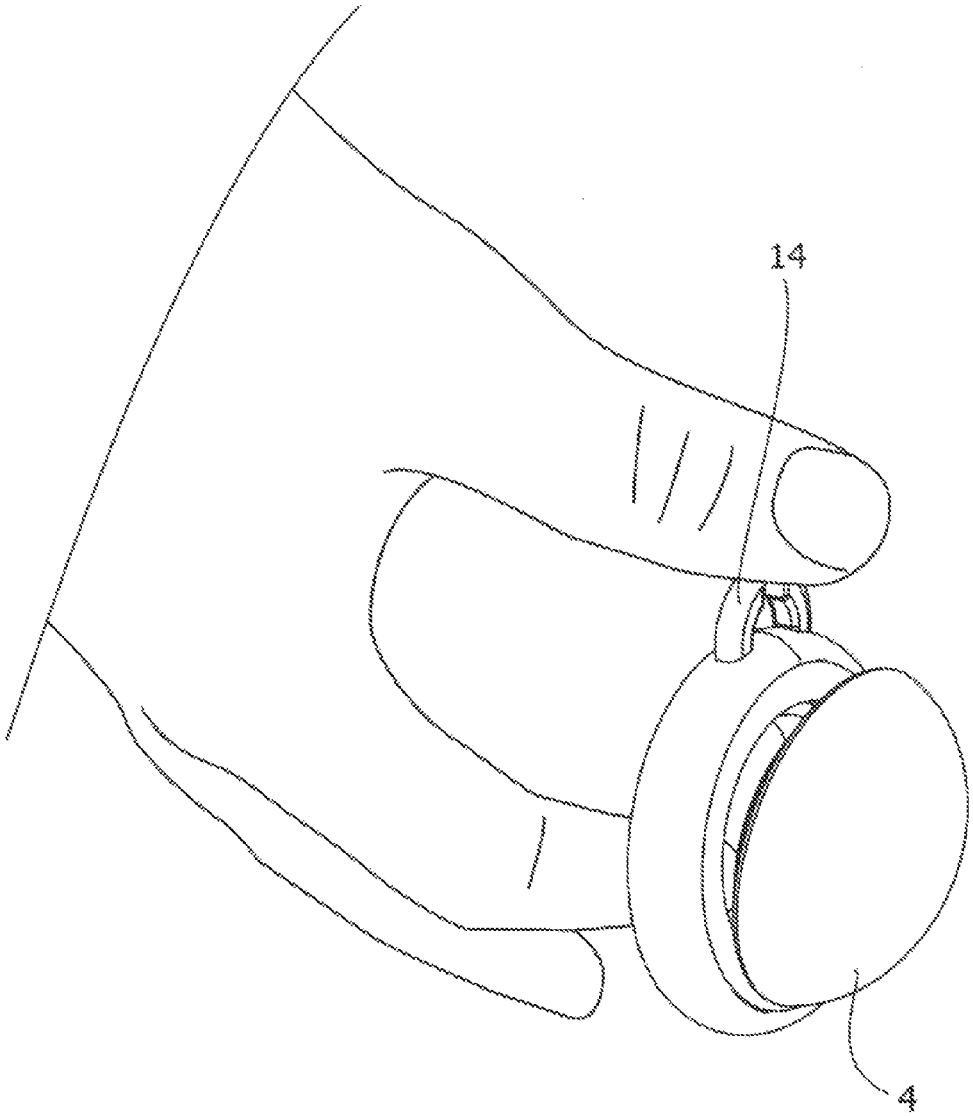
FIG. 6 is a perspective view of the pendant in FIG. 3 while the ornamental element is removed from its frame.

A through aperture 11 extends through the central recess 3 of the frame 13. The through aperture 11 has such a dimension that a hand finger can be introduced in it, as shown in FIG. 6 that is a perspective view of the pendant in FIG. 3, while the ornamental element is removed from its frame. The finger exerts a pressure on the bottom 6 of the ornamental element 4 for overcoming a mutual attraction force exerted by the two magnets. As will be shown below the removal of the ornamental element from the frame is thus obtained. On the contrary, it will be sufficient to approach the frame to another ornamental element so that the latter is captured and automatically positioned with its bottom in the central recess.

It is known that a similar but lower effect can be obtained when the attractive force is exerted by a single magnet on a ring of paramagnetic material. So, for example, a magnet can be fixed on the ornamental element while an element of iron or other material with magnetic permeability having the same shape of the magnet can be fixed on the frame.

The frame 13 has a semi-ring 14 in which a mesh ring 15 of a chain or the like (not shown) is inserted.

Figure 7:
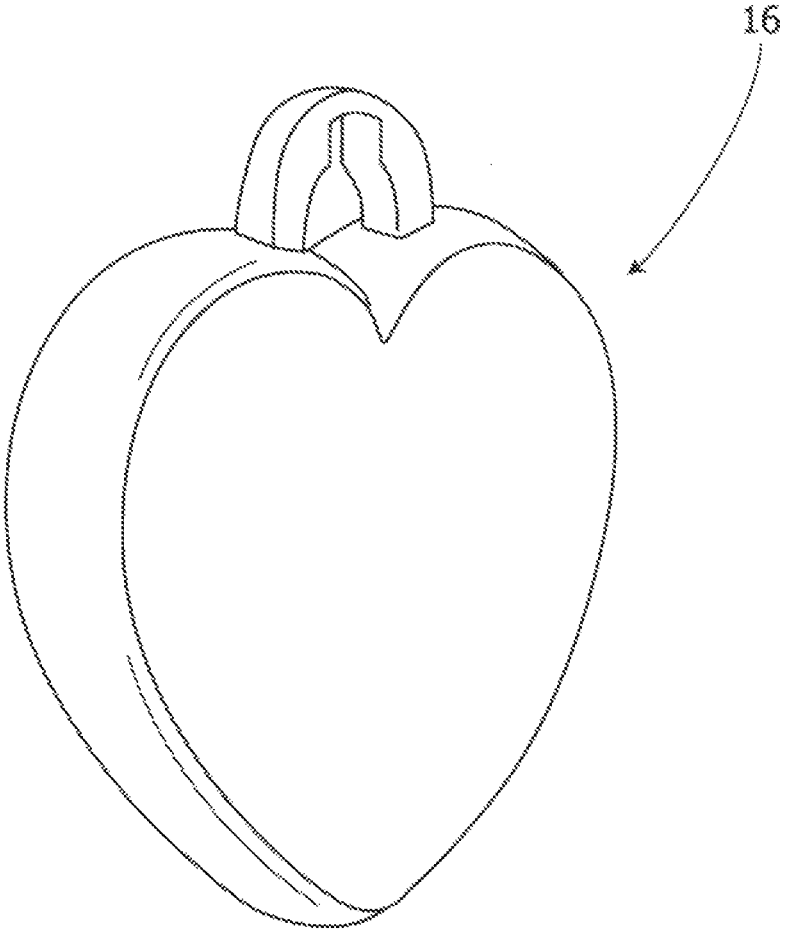
FIG. 7 is an assembled perspective view of a heart-shaped pendant.

Referring to the perspective view in FIG. 7, there is shown a stylized heart-shaped pendant 16. Perimeter grooves and magnets have the same shape.

Figure 8:
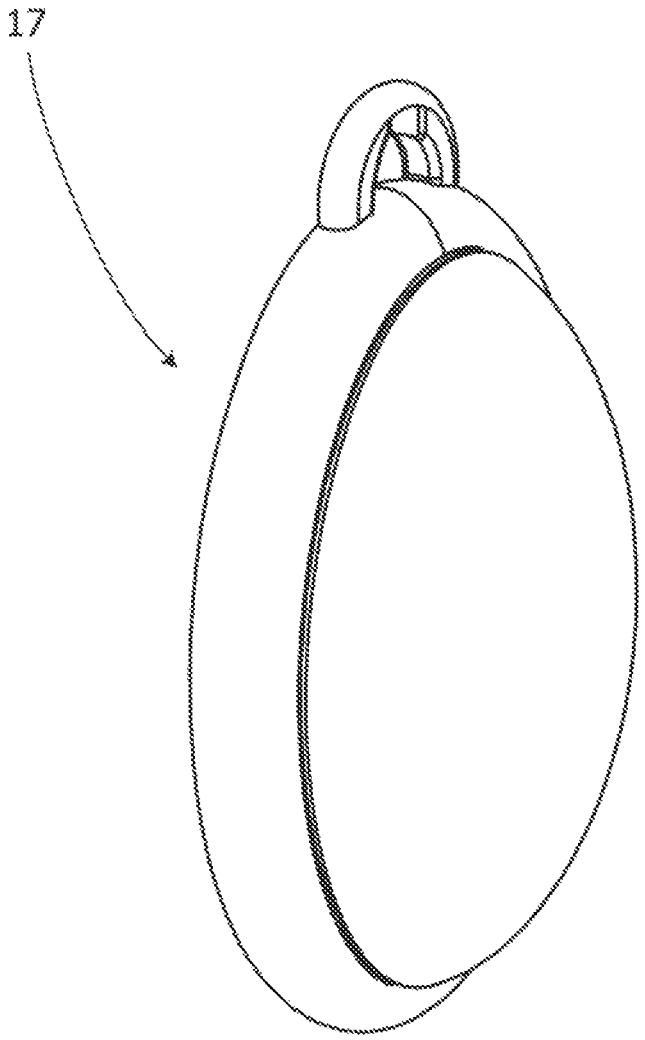
FIG. 8 is an assembled perspective view of an oval pendant.

Referring to the perspective view in FIG. 8, there is shown an oval pendant 17. Even in this case, the perimeter grooves and the magnets have such a form.

It is understood that the objects of the present invention have been achieved. In particular, the gemstone or the like is easily replaceable without requiring the use of a tool, but is not susceptible to be accidentally detached from its frame.

The invention claimed is:

1. An article of jewelry comprising:

a replaceable ornamental element, the ornamental element (4) having a front face and an opposite rear face, the rear face defining a bottom (6) of the ornamental element (4), the ornamental element (4) further including a first perimeter groove (8) having a first face extending inwards from an outside perimeter of the ornamental element (4) and a second face extending forward from the bottom (6) of the ornamental element (4) towards the front face of the ornamental element (4), the first perimeter groove (8) being open towards the bottom (6) of the ornamental element (4) and open towards the outside perimeter of the ornamental element (4);

a first magnet (5) fixed to the first perimeter groove (8), the first magnet (5) having a front face, a rear face opposite the front face, an inner face, and an outer face opposite the inner face, the front face of the first magnet (5) being against the first face of the first perimeter groove (8) and facing the front face of the ornamental element (4), the inner face of the first magnet (5) being against the second face of the first perimeter groove (8);

a frame (2; 13) provided with i) a central recess (3) located at a frontmost part of the frame, the central recess (3) having an first inner perimeter defining a first opening at the frontmost part of the frame, ii) a through opening (11) that extends from a rear part of the frame to the central recess (3), the through opening (11) having a second inner perimeter defining a second opening located rearward of the first opening, the second inner perimeter being located radially within the first inner perimeter, an area of the first opening being greater than an area of the second opening, and iii) a second perimeter groove (10) located in the central recess (3), the second perimeter groove (10) having an outside side wall, an inside side wall, a bottom wall extending between the outside side wall and inside side wall, the second perimeter groove (10) being open towards the first opening at the frontmost part of the frame, the inside side wall being located radially between a) the first inner perimeter of the central recess (3) defining the first opening at the frontmost part of the frame and b) the second inner perimeter of the through opening (11) defining the second opening located rearward of the first opening; and a second magnet (7) fixed inside the second perimeter groove (10) located in the central recess (3), the second magnet (7) having a front face, a rear face opposite the front face, an inner face, and an outer face opposite the inner face, the rear face of the second magnet (7) being against the bottom wall of the second perimeter groove (10) and facing the rear part of the frame, the inner face of the second magnet (7) being against the inside side wall of the second perimeter groove (10), the outer face of the second magnet (7) being against the outside side wall of the second perimeter groove (10), wherein the ornamental element (4) is removably attached to the frame (2; 13) by the rear face of the first magnet (5) being magnetically attached to the front face of the second magnet (7) with the first magnet (5) being located within the central recess (3) of the frame, the front face of the ornamental element (4) extending forward of the frontmost part of the frame, wherein the through opening (11) and the first opening at the frontmost part of the frame (2; 13) permits an introduction of a hand finger being able to allow the decorative element (4) to be removed from the frame (2; 13).

2. The article of jewelry according to claim 1, wherein the decorative element is a gemstone.

3. The article of jewelry according to claim 1, wherein said first and second magnets (5, 7) have a circular configuration.

4. The article of jewelry according to claim 1, wherein said first and second magnets have a heart-shaped configuration.

5. The article of jewelry according to claim 1, wherein said first and second magnets have an oval configuration.

* * * * *